United States Patent [19]

Tabet

[11] Patent Number: 4,516,780

[45] Date of Patent: May 14, 1985

[54] ADJUSTABLE GOLF BALL TEE

[76] Inventor: Michael J. Tabet, Tabet Manufacturing Co., 1336 Ballentine Blvd., Norfolk, Va. 23516

[21] Appl. No.: 102,551

[22] Filed: Dec. 11, 1979

[51] Int. Cl.[3] ..... A63B 57/00

[52] U.S. Cl. ..... 273/202

[58] Field of Search ..... 273/202, 203, 33, 204, 273/205, 206, 208, 209, 211, 212

[56] References Cited

U.S. PATENT DOCUMENTS

| | | | |
|---|---|---|---|
| 1,803,907 | 5/1931 | Kruse | 273/202 |
| 2,079,387 | 5/1937 | Sickmiller | 273/202 |
| 3,690,676 | 9/1972 | Costa | 273/202 |

FOREIGN PATENT DOCUMENTS

| | | | |
|---|---|---|---|
| 427478 | 4/1935 | United Kingdom | 273/202 |

*Primary Examiner*—Richard C. Pinkham
*Assistant Examiner*—T. Brown
*Attorney, Agent, or Firm*—Stevens, Davis, Miller & Mosher

[57] ABSTRACT

An adjustable golf ball tee has a peg having a pointed end to facilitate pressing of the tee into the ground. The peg has a longitudinal bore which is open at one end and closed at the opposite end. An elongated ball supporting member is slidably disposed in the bore and extends through the open end for adjusting the height of a ball supported on the tee above the ground. A ball seat is provided on the exposed end of the ball supporting member. The ball seat has a concave surface corresponding substantially to the contour of the peripheral surface of a golf ball. The golf ball supporting member is slit longitudinally and, in a preferred embodiment, a first pin is disposed through the slit and anchored at each end to the peg wall. The end of the pin is closed with a second pin disposed across the slit with its ends embedded in the ball supporting member or by the slit terminating short of the end of the supporting member. The longitudinal axis of the second pin or of the closed end of the slit is at an angle of less than 180° with the longitudinal axis of the first pin and crosses the slit inwardly of the first pin so that the supporting member cannot be removed completely from the bore through the open end of the bore.

4 Claims, 5 Drawing Figures

ADJUSTABLE GOLF BALL TEE

This invention relates generally to a golf ball tee and more particularly to an improved golf ball tee which is vertically adjustable to position a golf ball supported thereon at a predetermined height above the ground.

It has been proposed before to provide a golf ball tee of adjustable height for supporting a golf ball in spaced relation above the ground to facilitate striking the ball with a golf club. For example, an adjustable support or anchor for a golf ball tee having an upright cylindrical housing, with a vertical bore in which the stem of a conventional golf ball tee is slidably disposed is disclosed in U.S. Pat. No. 1,803,907. The upper end of the bore is closed with a flexible rubber closure having a restricted opening which fits snugly about the stem of a golf ball tee to position the tee at one of various elevations in the bore. Such a device is relatively complicated to make and requires an anchor which imparts configuration to the tee which makes it awkward to carry in a golfer's pocket.

A combination golf ball tee and marker having a cylindrical casing, divergent arms mounted in the casing and a notched bar supported by the arms and in turn supporting a golf ball tee is disclosed in U.S. Pat. No. 1,929,579. Such an arrangement is impractical to carry in a golfer's pocket, is too costly and requires digging a relatively large hole in the ground for insertion of the casing.

Another adjustible golf ball tee is disclosed in U.S. Pat. No. 2,693,358. The golf ball tee has a hollow frustoconical base having an inwardly directed annular flange around an opening in its top. A cylindrical ball support member is slidably disposed through the opening into the base member. The annular flange presses against the cylindrical member and holds it at various elevations. This type of golf ball tee is made of cardboard and has the disadvantage of sometimes failing to support the weight of the ball particularly if the tee is wet. Moreover, because of its light weight and the fact that it sits on top of the ground, it is frequently blown away before the ball is hit.

A plastic golf ball tee of substantially the same general configuration as that of U.S. Pat. No. 2,693,358 is disclosed in U.S. Pat. No. 3,690,676. Such a golf ball tee has the disadvantage of being awkward to carry in a golfer's pocket and must be recovered to be reused in order to be economically feasible.

The golf ball tee disclosed in U.S. Pat. No. 3,114,557 has an elongated substantially cylindrical peg with a pointed end for insertion in the ground and an opposite end for supporting a golf ball. Vertically disposed, longitudinally spaced lugs on the wall of the peg combine with studs on a vertically adjustable ground engaging collar which adjusts the height of the tee above the ground. The manufacture of such a tee with lugs and a collar with studs is relatively complicated and expensive and because of the collar, the tee is not easily carried in a pocket.

A practice tee for supporting a ball such as a baseball or tennis ball for practice swings is disclosed in U.S. Pat. No. 2,884,250. The tee has a bellows at its top and pivots out of the way if a ball striking device strikes it. Such a tee cannot be used to advantage with a golf ball.

It is an object of this invention to provide an adjustable golf ball tee which is relatively simple to make and can be made in quantities at low cost. Still another object of the invention is to provide a golf ball tee particularly well suited for manufacture by injection molding techniques. A further object of the invention is to provide a golf ball tee which can be easily inserted in the ground, can be adjusted quickly to the desired height above the ground and can be relied upon to support the ball at its chosen height until it is struck by a golf club. A still further object of the invention is to provide a light weight golf ball tee which can be adjusted in height to reliably support a golf ball at a predetermined elevation above the ground, can be inserted in the ground so it will not be blown over or away and yet is of a size, weight and configuration which adapt it to be carried in a golfer's pocket. A more specific object of the invention is to provide a golf ball tee which will support the ball above the ground at a predetermined elevation, is secured in the ground and is as conveniently carried and inserted in the ground by a golf player as the conventional non-adjustably pointed peg popularly used heretofore.

Other objects will become apparent from the following description with reference to the accompanying drawing wherein.

The foregoing objects and others are accomplished in accordance with this invention, generally speaking, by providing a two-piece golf ball tee having an elongated body having a pointed end for penetrating the ground and a seat for a golf ball on its opposite end wherein one of the pieces is slidably disposed in a bore of the other to provide for adjustment of the height of the tee above the ground. The body of the tee provided by the invention is formed of two pieces with an elongated ball supporting member slidable vertically in a longitudinal bore extending from an open upper end into a bore in a peg shaped base member. The ball supporting member fits snugly in the bore of the peg so that a golf ball resting on the ball seat of the ball supporting member is supported against loss of elevation under the weight of the ball by gravity. In a preferred embodiment of the invention, the ball support member is slit longitudinally and the end of the slit is closed such as with a pin disposed laterally across the slit near that end of the ball support member which is enclosed in the bore of the peg. A second pin extends through the slit and across the bore in the peg near the open end of the bore in the peg. This arrangement prevents separation of the ball supporting member from the peg. Alternately, those portions of the ball supporting member on opposite sides of the slit can be sprung apart so their free ends press against the wall of the bore and the pins can be eliminated. The wall of the supporting member may be roughened such as by sanding, to provide greater friction between the supporting member and the wall of the bore to retard separation of the ball supporting member from the peg.

Figure 1:
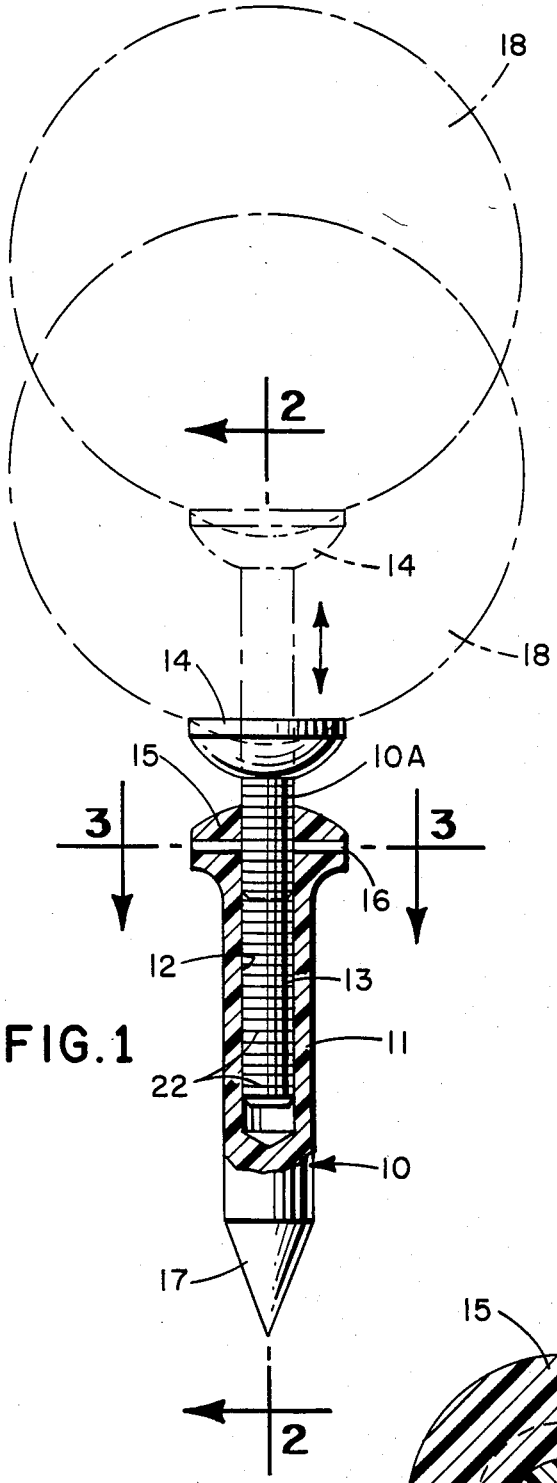
FIG. 1 is an elevation, partially in section and partially in phantom illustrating one embodiment of the invention.
Figure 2:
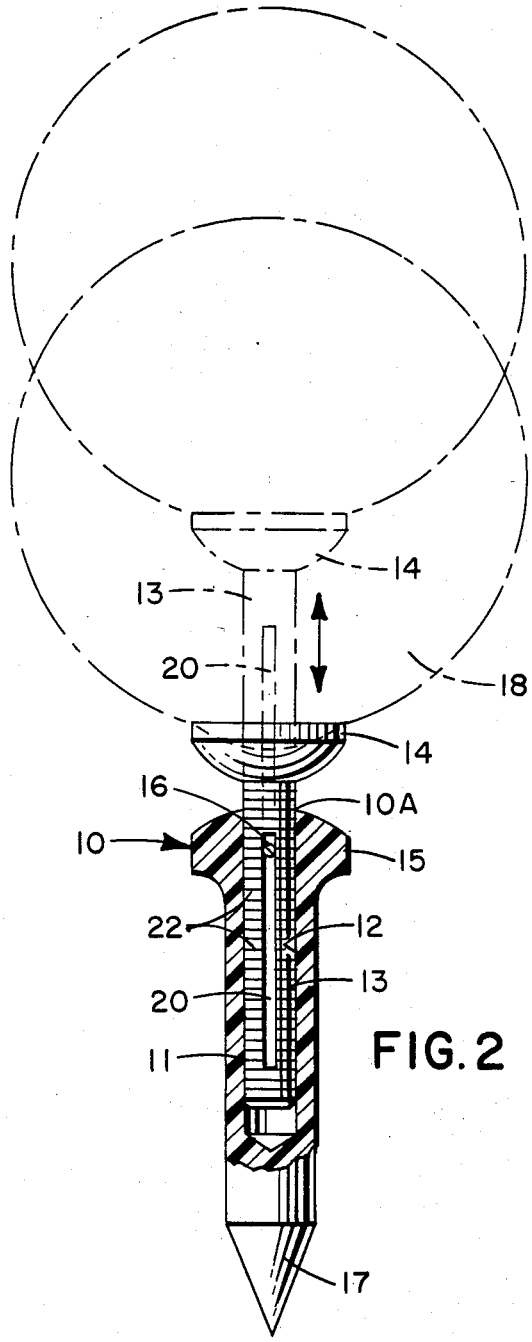
FIG. 2 is an elevation of the embodiment of FIG. 1, also partially in section and in phantom taken along the line 2—2 of FIG. 1.
Figure 3:
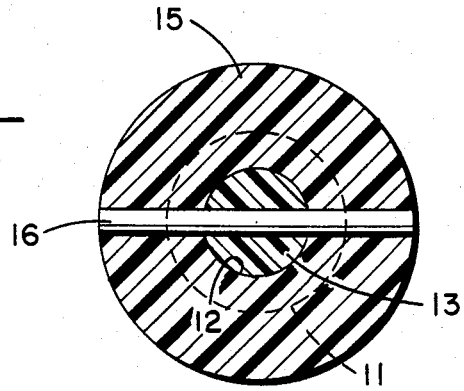
FIG. 3 is a cross-section taken along the line 3—3 of FIG. 1.
Figure 4:
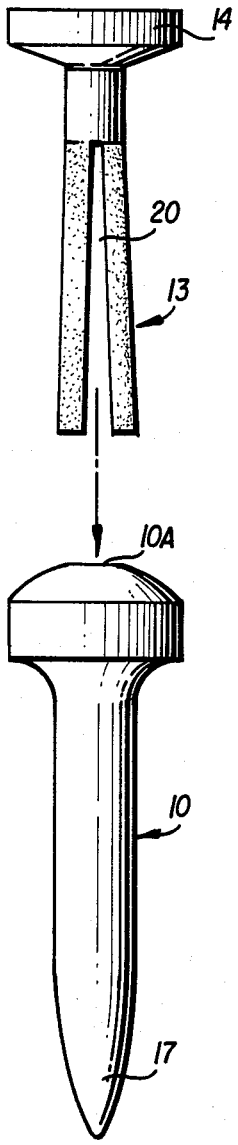
FIG. 4 is an exploded view of a second embodiment of the invention.
Figure 5:
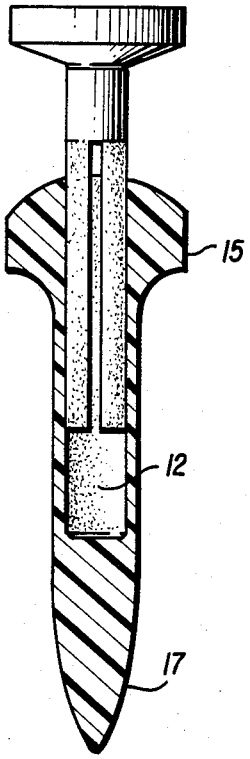
FIG. 5 is an elevation of the embodiment of FIG. 4.

Referring now to the drawing, the illustrated embodiment of a golf ball tee 10 of the invention has an elongated generally cylindrical body or peg 11. A longitudinal bore 12 extends from open end 10A into peg 11 towards a pointed end, i.e. conical end, of peg 11 which facilitates seating a tee 10 in the ground or other penetratable supporting medium. Bore 12 terminates short of the conical end 17 of peg 11. Enlongated substantially cylindrical member 13 is slidably disposed in bore 12 with its golf ball seat 14 exposed above the open end 10A of bore 12. As shown in the drawing the ball seat has a concave upper surface conforming to the periphery of the golf ball 18 to discourage rolling of the ball off of the tee 10. A pin 16 extends laterally through bore 12 with its ends embedded in shoulder 15. Pin 16 also passes through slit 20 in member 13. A pin 19 extends laterally through slit 20 and has its ends embedded in member 13 on opposite sides of the slit. Pin 19 is disposed substantially at a right angle to the longitudinal axis of pin 16 so pin 16 stops vertical movement of pin 19 and simultaneously prevents removal of member 13 from bore 12. Both pins 16 and 19 can be eliminated when the two side members on opposite sides of slit 20 are sprung apart or slit 20 ends in spaced relation with the end of member 13 so there is a cross-bar across the end of slit 20, or the surface is roughened as shown in FIGS. 4 and 5 to provide the contact with the wall of bore 12 required to support ball 18 at the desired elevation. However, care must be taken when sliding member 13 towards the open end of bore 12 to avoid complete removal of member 13 from bore 12 with separation of tee 10 into its two members 13 and 11.

The two members 11 and 13 are preferably made by injection molding a suitable synthetic resin such as polyvinyl chloride, polyethylene or other injection moldable crystalline plastic, or elastomer to form a rigid tee adapted to be pushed into the ground although they can be made from wood or metal. The assembly of parts 11 and 13 should be sufficiently rigid and strong to support the weight of a golf ball above the ground or other supporting surface and for pushing the peg 13 into the ground to a depth where the tee and ball are supported in a substantially upright position without bending or other distortion of member 11 or member 13.

In a typical embodiment of the invention, the overall length of the tee when member 3 is disposed in bore 12 with the golf ball seat 14 resting on the upper surface of shoulder 15, is about 2 inches so the tee is easily carried by a golfer in his pocket. A typical diameter of peg 11 is about 3/16 inch with a seat of about ½ inch. The length of member 11 can vary but should be sufficient to extend into bore 12 far enough to provide stability of the assembly of parts 11 and 13 without bending or breaking of the assembled parts.

Although the invention has been described in detail for the purposes of illustration, it is to be understood that such detail is solely for the purpose of illustration and that variations can be made therein without departing from the spirit and scope of the invention except as it may be limited by the claims.

I claim:

1. A golf ball tee which is adapted to be fixed in the ground in an upright position and to support a golf ball at a selected elevation above the ground, said golf ball tee comprising a peg having a pointed end for penetration of the ground and an opposite end, a bore extending longitudinally in the peg commencing with an open end in said opposite end of the peg and extending longitudinally towards said pointed end of the peg, said bore terminating in a closed end, an elongated ball supporting member slidably disposed in said bore, having a ball seat on one end exposed above said open end of the bore, and having a longitudinal slit therein, and a means for restraining said ball supporting member against complete removal from the bore comprising a pin disposed laterally across said bore and through said slit and means disposed across the slit and at an angle with respect to the longitudinal axis of the pin closing said slit against movement over said pin, said pin being disposed inwardly in the bore from the pin whereby the slit closing means strikes the pin when the support member slides in the direction from the said pointed end and the elongated support member is prevented from being completely removed from the said bore.

2. The golf ball tee of claim 1 wherein the peg and ball supporting member are plastic.

3. The golf ball tee of claim 1 wherein the said seat has a larger cross-section than said bore.

4. The golf ball tee of claim 1 wherein the said slit is closed at both ends against passage of said pin.

* * * * *